United States Patent [19]

Harmon et al.

[11] 4,186,539

[45] Feb. 5, 1980

[54] INTERLOCKING MODULAR BUILDING PANEL WITH SEALING STRIP

[75] Inventors: William M. Harmon, Worthington; Lindell R. Holtzmeier, Athens; Toshiaki Yamamoto, Columbus, all of Ohio

[73] Assignee: United McGill Corporation, Columbus, Ohio

[21] Appl. No.: 876,499

[22] Filed: Feb. 9, 1978

[51] Int. Cl.[2] ..... E04C 1/14

[52] U.S. Cl. ..... 52/580; 52/582; 52/588; 52/594; 52/595

[58] Field of Search ..... 52/580–595

[56] References Cited

U.S. PATENT DOCUMENTS

| | | | |
|---|---|---|---|
| 3,372,520 | 3/1968 | Hensel | 52/595 X |
| 3,386,218 | 6/1968 | Scott | 52/595 |
| 3,742,672 | 7/1973 | Schaeufele | 52/588 |
| 3,998,023 | 12/1976 | Anderson | 52/595 |

*Primary Examiner*—J. Karl Bell

*Attorney, Agent, or Firm*—Robert E. Stebens

[57] ABSTRACT

A modular building panel is provided having interlocking bead and groove conformations formed in mating interfitting tongue and socket structures and provided with sealing strips for forming a fluid seal between adjacent assembled panels. The modular building panel is fabricated with longitudinally extending marginal edge portions of mating tongue and socket configurations for enabling interfitting assembly of adjacently disposed panels. The tongue and socket edge portions of each panel are provided with respective interlocking bead and groove conformations for cooperative interlocking engagement for securing adjacently disposed panels in assembled relationship. A sealing strip formed from an elastomeric material is attached to at least one of the socket or tongue marginal edge portions in longitudinally extending relationship thereto and at a location for contacting interengagement with surfaces of the adjacently assembled panel in forming a fluid impervious seal therewith.

6 Claims, 6 Drawing Figures

INTERLOCKING MODULAR BUILDING PANEL WITH SEALING STRIP

BACKGROUND OF THE INVENTION

This invention is directed to providing of an improved fluid impervious seal in conjunction with modular building panels of a type such as that which is disclosed in U.S. Pat. No. 3,742,672 issued July 3, 1973 to Herman J. Schaeufele. That patent discloses a building having opposed longitudinally extending modular edge portions that are configured as mating tongue and sockets. This configuration enables two adjacent panels to be assembled in interfitting relationship to form a composite wall structure. Each tongue or socket marginal edge portion is provided with a respective interlocking bead and groove conformation that cooperatively interlock when the panels are assembled in interfitting relationship and are operative to mechanically secure the panels in composite wall structure.

As illustrated and clearly disclosed in U.S. Pat. No. 3,742,672, the simple sealing expedient of providing a caulking compound is employed to obtain a fluid impervious seal that is required in many modular building assemblies utilizing panels of this type. As disclosed in that patent, this technique requires that, during the field assembly of the panels into the desired building structure, the workmen also apply a suitable caulking compound in a plastic or paste state to the interlocking groove in a manner whereby, when the panels are assembled, the bead conformation of the opposite panel will become embedded in the caulking relationship between adjacent and opposed surface portions of the bead and groove. While this technique has proven satisfactory in obtaining the necessary fluid impervious seal, the technique does represent a substantial economic cost in the assembly procedure. This economic cost is a direct consequence of the fact that it is necessary for the workmen to apply the caulking compound in the field and this represents an additional operational step consuming substantial time.

Additionally, it is necessary that the workmen utilize extreme care in assuring that there is a uniform quantity of the caulking compound distributed throughout the entire interlocking groove as any irregularities in the quantity will tend to produce leaks when two adjacent disposed panels are interfit in assembled relationship. Discovery of the leaks that are thus produced does not occur until such time as the completed building structure is subjected to an air pressure test and, at that time, it then becomes necessary to attempt to locate the leaks and to attempt successful completion of resealing procedures. Not only is there difficulty in locating the leaks, accompanied by an associated expenditure of time, but substantial effort is then required to properly effect a suitable fluid impervious seal between the interlocking bead and groove which is affected.

Difficulty in obtaining the required fluid impervious seal is also a consequence of the procedures or techniques for assembling interlocking panels into a composite structure. Assembly techniques of the panels require that the interfitting tongue and socket marginal edge portions be of a dimension such that there is an interference fit in the edge-wise assembly of the panels. Consequently, as the panels are pushed into interlocking relationship, there is a tendency for the bead and groove conformations to operate in a manner to displace the caulking compound from its desired location even though the workmen have properly applied the caulking compound. This displacement of the caulking material, prior to the final interfitting assembly of the panels, also results from a technique of assembly wherein the panels are initially joined at an end in angular relationship and pivoted into parallel aligned relationship. This pivotal swinging movement of the two adjacent panels during assembly also results in a greater tendency for the caulking compound to be inadvertently displaced from a groove and result in fluid leaks.

SUMMARY OF THE INVENTION

This invention is directed to providing a modular building panel of the interlocking type, such as that disclosed in U.S. Pat. No. 3,742,672, and is provided with a sealing strip formed from an elastomeric material that is carried on at least one component of a longitudinal edge of either the tongue or socket marginal edge portion of the panel. In accordance with this invention, the sealing strip is secured to the structure at the factory as one of the steps in fabrication of a panel either by mechanical clamping techniques or through adhesive bonding and is thus provided with a panel in preassembled relationship when the panel is shipped for installation and assembly. This providing of the sealing strip as an integral component of the panel at the time of its fabrication in a factory or suitable manufacturing facility, eliminates the necessity of workmen in the field having to apply a suitable caulking compound or other sealing element at the time of assembly into a composite wall structure.

In one embodiment of this invention, the sealing strip is provided as a flat strip of elastomeric material that is clamped between interfolded elements of the socket portion and is thus carried in a protected position. In this embodiment, the sealing strip is carried at an inwardly facing surface of the socket and is thus not exposed to mechanical injury or damage during normal handling operations. The positioning and location of the sealing strip is such that, as the interfitting tongue and socket are assembled, the strip is also maintained in protected position and is not subjected to frictional dragging forces as the mating parts are slid together. The sealing effect is only obtained at the time that the interfitting bead and groove interlock and it is at this time that the elastomeric material is thus compressibly secured between opposed surfaces of the two interfitting components.

An alternative arrangement of this embodiment provides the elastomeric sealing strip in at least one of the longitudinally extending grooves where it is secured by suitable adhesive. The strip is of a thickness substantially less than the depth of the groove and is thereby effectively protected from mechanical injury during transport while adjacent panels are assembled into interlocking relationship.

In another embodiment of this invention, a sealing strip of elastomeric material is secured to a longitudinal, laterally projecting end edge of the tongue marginal edge portion. In this embodiment, the sealing strip is positioned to be secured in clamped relationship between opposed surfaces of two adjacently disposed panels that are assembled and does not depend on distorion through the compression in the region of the bead and groove. Effective fluid sealing is obtained through the compression of the sealing strip between the end edge contacting surfaces of the two components.

Panels embodying this invention are generally fabricated with each of the tongue and socket edge portions having interlocking bead and groove conformations formed on each side thereof. However, effective sealing of the panels requires use of an elastomeric sealing strip with only one bead and groove in accordance with this invention. Utilization of more than one sealing strip, or multiple combinations thereof is contemplated and within the scope of this invention.

Providing of the modular building panels of the interlocking type with a sealing element in this manner, eliminates the necessity of otherwise utilizing field application techniques for the sealing mechanisms such as a caulking compount. This procedure eliminates the costly field erection cost otherwise incurred, and results in a materially enhanced fluid impervious seal. Providing of the seal, as a component of the building panel, avoids the otherwise strong possibility that the seal may be ineffectively formed or may be adversely affected during assembly procedures. This generally reliable seal thus reduces costs that are otherwise incurred through utilization of procedures required for location of leaks and for the subsequent repair of those leaks. Furthermore, this sealing technique may be applied to both side of a panel, if desired, to enhance the sealing effectivity.

These and other objects and advantages of this invention will be readily apparent from the following description of illustrative embodiments thereof and the accompanying drawings.

DESCRIPTION OF THE DRAWING FIGURES

DESCRIPTION OF THE ILLUSTRATIVE EMBODIMENTS OF THE INVENTION

Figure 1:
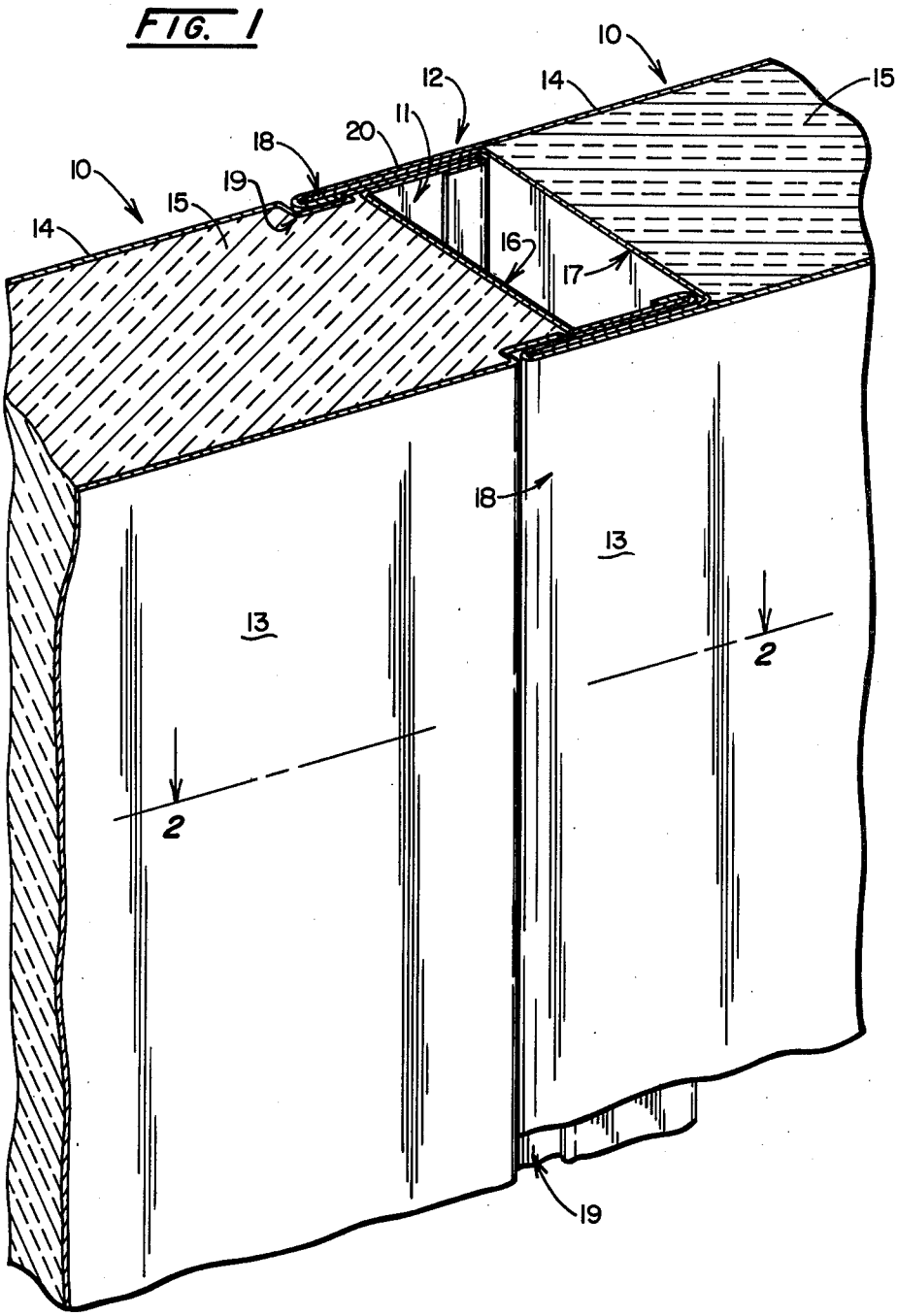
FIG. 1 is a perspective view of a fragmentary wall section comprising a pair of adjacently disposed panels embodying this invention.

Referring to FIG. 1, a fragmentary wall section is shown as comprising two assembled modular building panels 10 which are fabricated in accordance with this invention. The two panels 10 are shown as assembled in forming of a composite wall structure for a building or other apparatus. These panels are shown as only fragmentary portions and it will be understood that the length and width of the panels will be as determined appropriate for the particular utilization and building structure. Also, while a vertical wall structure is referenced, it will be understood that this invention is equally applicable to structures that are disposed in other than vertical planes.

Each of the panels 10, as shown in FIG. 1, embodies a basic structural configuration that is essentially similar to that which is described in U.S. Pat. No. 3,742,672. Accordingly, some of the details as to the configuration and its operative relationship will only be briefly described herein as details pertinent to the more general aspects of the panel structures may be readily obtained from that patent. For the purposes of this invention, it will be sufficient to note that each of the panels is provided with opposed longitudinally extending marginal edge portions that are respectfully defined as tongue and socket marginal edge portions 11 and 12. As is shown and described in greater detail in the noted previously issued patent, these panels are also fabricated as composite structures utilizing thin sheet metal skins 13 and 14 as the exterior components thereof and having the interior substantially filled with suitable thermal insulating material 15.

The tongue and sockets 11 and 12 are configured to interfit and thus the tongue is of a relatively narrower width than the opening of the socket. Each is advantageously formed by appropriate bending or forming of the skins 13 and 14 to define respective channels, opening at edges of the panels and providing of associated U-shaped channels 16 and 17. Each of the channels 16 and 17 is of depth sufficient to enable the sidewall portions of the tongue or socket 11 and 12 to adequately flex during assembly of adjacent panels and permit insertion of the tongue into the socket. The channels 16 and 17 are provided for structural stiffening of the modular edge portions and mechanical coupling of the two opposed sheet metal skins 13 and 14. Accordingly, each of the channels 16 and 17 is securely assembled with the respective skins either through mechanical coupling therewith or by utilization of other appropriate fastening means. In the illustrative embodiment, these channels are shown as being at least partially mechanically secured through appropriate folding over and bending of portions of the outer skins 13 and 14.

It will also be noted that, as in accordance with the structure disclosed in U.S. Pat. No. 3,742,672, the panels 10 are provided with cooperative and interfitting bead and groove conformations 18 and 19 with the tongue and socket configurations being shown in greater detail in FIG. 2. The groove 19 in the skin 13 is formed in the edge portion of the tongue 11 as an outwardly opening U-shaped channel extending longitudinally along the panel at a point immediately inward and adjacent the respective channel 16. The groove is of a width to receive the bead 18 which is integrally formed with and facing inwardly relative to surfaces of the socket 12. It will be noted that, while reference is made to a structure having a single interlocking bead and groove, the illustrative embodiment has such elements formed in each skin or surface 13 and 14.

Forming the socket 12, at the one side of the panel, are lateral extensions of the respective skins 13 and 14 which project in coplanar relationship to a respective flange of the channel 17. A terminal, longitudinally extending edge strip 22, of each lateral extension 20, is folded around the end of the flange 21 to extend in overlapped, coplanar relationship to the opposite surface thereof and, in cooperation therewith, defines the bead 18.

The tongue marginal edge portion 11 is formed in a manner similar to that of the socket and includes a lateral extension 23 of the respective sheet metal skins 13 and 14 with this extension projecting outwardly with respect to the groove 19. This lateral extension 23 is also disposed in coplanar relationship to a flange 24 of the respective channel 16. A longitudinally extending terminal edge strip 25 of the extension 23 is folded over and around the flange 24 in securely clamped relationship.

In accordance with this invention, a sealing strip 26 is provided for attachment with one of the tongue or socket marginal edge portions 11 or 12. In the illustrative embodiment of FIG. 1, and as also shown in the sequential assembly FIGS. 2, 3, and 4, this sealing strip 26 is associated with the socket marginal portion 12. Forming the sealing strip 26 is a relatively thin flat layer of an elastomeric material, such as a rubber or a suitable synthetic resin material having appropriate resilient characteristics and is of a length to extend entirely along the marginal edge portion of the panel. As can be best seen in FIG. 2, this sealing strip 26 is of a width to have a longitudinally extending, marginal edge portion 27 thereof disposed in coplanar relationship between the opposed surfaces of the flange 21 and the terminal edge strip 22. The assembly is such that the sealing strip is mechanically clamped in position through a friction fit that is sufficient to maintain the strip in assembled relationship and resist normal efforts and expected forces to dislodge the strip from this position. As thus assembled, the edge portion 27 is seen to be slightly compressed with respect to the remaining portion that overlies the flange 21.

Figure 2:
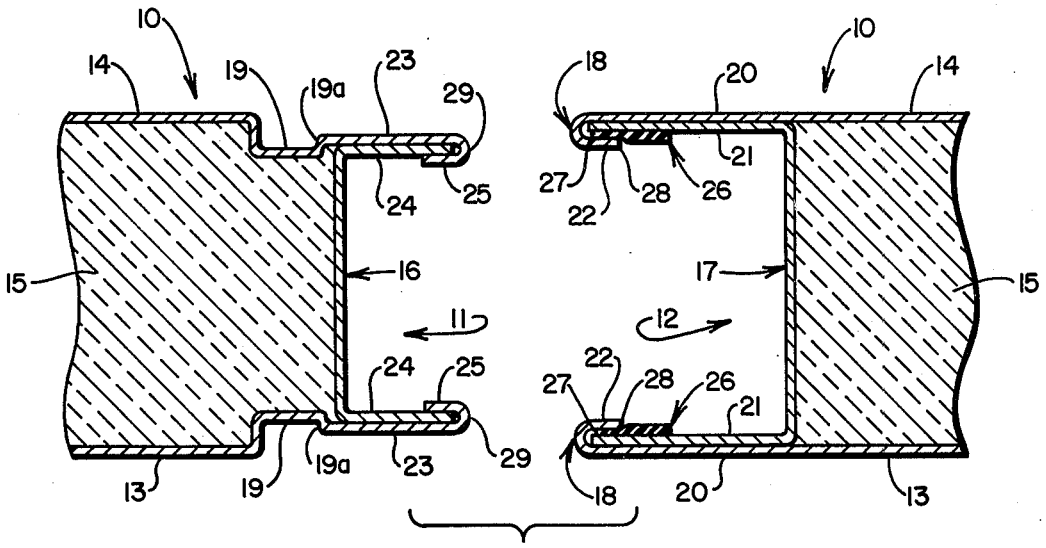
FIG. 2 is a fragmentary horizontal sectional view on a substantially enlarged scale taken along line 2—2 of FIG. 1, but showing the two adjacent panels as disposed prior to assembly.
Figure 3:
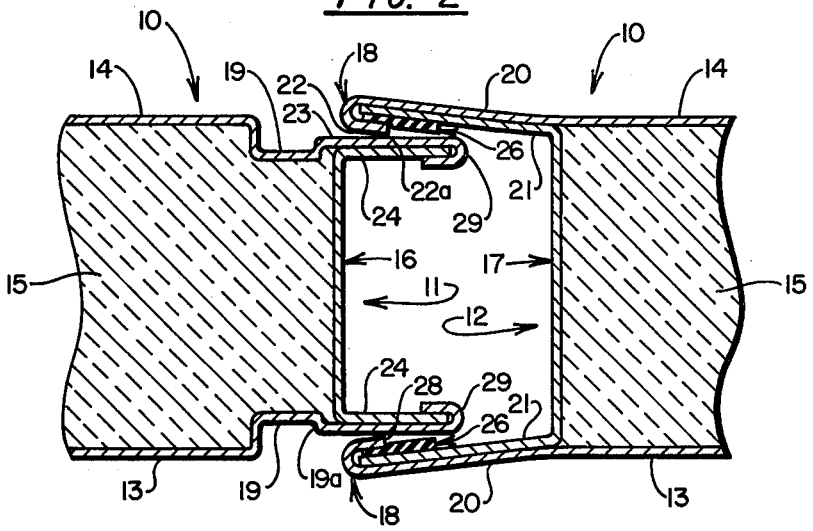
FIG. 3 is a horizontal sectional view similar to FIG. 2 with the two adjacent panels partially assembled.

Referring to FIG. 2, it will be seen that two adjacent tongue and sockets 11 and 12 of adjacently disposed panels are shown as positioned immediately prior to assembly. No particular technique or assembly is attempted to be shown in FIGS. 2, 3 and 4 and it will be understood that two adjacent panels may be merely pushed laterally or pivoted together in an edgewise manner to cause a tongue 11 of the one panel to be inserted in the socket 12 of the adjacent panel.

As can be readily seen in FIG. 2, the relative width dimensioning of the tongue 11 and socket 12 are such that the lateral spacing between the opposed surfaces of the socket terminal edge strips 22 is less than the width at the outer side surfaces of the lateral extensions 23 of the tongue. This dimensional relationship results in the fact that the terminal edges 22, which define the bead 18, will be securely received and engaged within a respective groove 19 when two adjacent panels are assembled. However, in assembling the tongue and socket, it will be seen that the flange portions of both the tongue and socket must necessarily flex to a sufficient degree to permit the interfitting assembly. This is diagrammatically illustrated in FIG. 3 where the tongue 11 and socket 12 are shown at an approximate mid-point in the assembly process. In this position, the terminal edge 22 will have its extreme corner 22*a* riding on the outer surface of the tongue's lateral extension 23 while other portions of the flange 21 wll be riding along the outer rounded corner 29 of the tongue 11. In this position, the sealing strip 26 will not be in contacting engagement with the surface of the tongue extension 23 and thus will not interfere with the movement of the two elements toward their assembled positions. A distinct advantage of this arrangement is that the sealing strip 26 is thus well protected during the assembly procedure and will not be damaged by the assembly operations.

Figure 4:
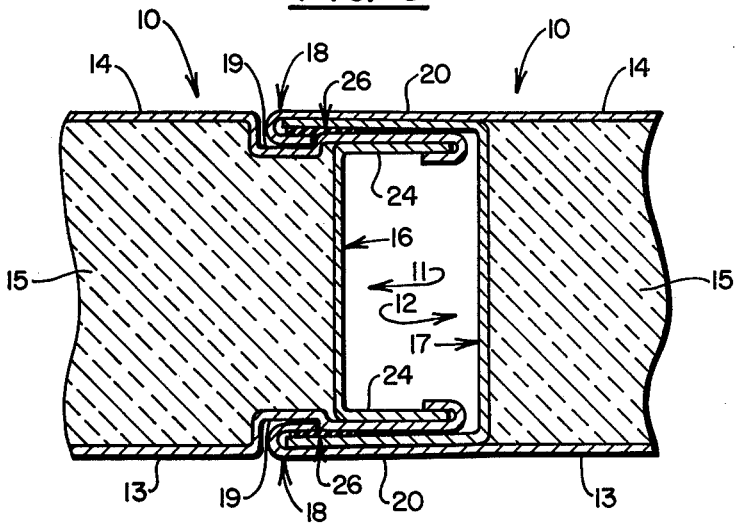
FIG. 4 is a horizontal sectional view similar to FIGS. 2 and 3 with the two panels completely assembled.

Completion of the assembly of the two elements into interfitting engagement is shown in FIG. 4. In this position, the bead 18, which includes the terminal edge 22, is shown projecting into the groove 19 where the end corner 28 interlocks with a longitudinal sidewall 19*a* of the groove. The functioning of the sealing strip 26 will also be readily seen in FIG. 4 where the portion of the strip that is not secured between the terminal edge 22 and the flange 21, will now be secured in clamped relationship between the opposed outer surface of the lateral extension 23 of the tongue and the inwardly facing surface of the flange 24. Accordingly, it will be seen that an excellent fluid impervious seal will be formed by this clamped relationship of the sealing strip between the tongue and socket components in cooperation with the bead and groove conformations. Also, it was previously indicated that, although the sealing strip 26 is secured in assembled relationship with the socket to prevent its accidental and inadvertent removal, the clamping effect is not such that the strip cannot be pulled out from this receiving socket. The reason for this particular assembly and fabrication technique is that the strip 26 may thus be pulled a distance outwardly through the clamping of the strip between the flange 24 and the tongue extension 23 as the tongue and socket approach their final assembly position of FIG. 4 when the bead 19 drops into the groove 19. This will assure that the sealing strip exposed for contact with the outer surface of the tongue will not be stretched laterally to any degree that would materially reduce the thickness of the strip.

Figure 5:
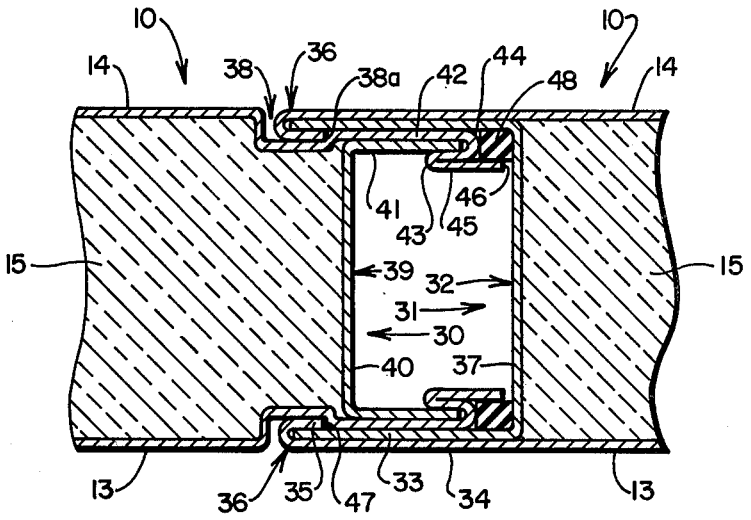
FIG. 5 is a fragmentary horizontal sectional view similar to FIG. 4 of a modified structure.

A modified form of the tongue and socket is illustrated in FIG. 5. This figure is a horizontal sectional view similar to FIG. 4 and shows the tongue and socket portions of two adjacent panels in assembled relationship. For purposes of distinction, the tongue marginal edge portion is designated by the numeral 30 whereas the socket marginal edge portion is designated by the numeral 31. The socket portion is formed in substantially the same manner, as that previously described, and includes a C-shape channel 32 having flanges 33 which are disposed in parallel relationship to lateral extensions 34 of the respective panel skin 13. As in the previously described embodiment, each lateral extension 34 includes terminal strips 35 which are folded around the respective flange 33 to form a bead 36. The channel 32 also includes a web 37 extending transversely across the space between the two skins 13 and 14.

The construction of the tongue portion 30 is modified from that previously described although the construction does incorporate a groove 38. Also included in the tongue construction is a C-shaped channel 39 having a web 40 extending transverely across and between the two skins 13 and 14 terminating in relatively short flanges 41. The tongue 30 also includes a lateral extension 42 which projects a distance outwardly from the groove 38 with a terminal edge strip 43 of the lateral extension folded around the flange 41 forming an end surface 44. A reverse projecting lip 45 is also integrally formed with the edge strip 43 and extends a distance laterally outward with respect to the remainder of the end of the tongue. The combined length of the groove 38, lateral extension 42 and their reverse projecting lip 44 is such that, with the tongue and socket assembled as illustrated in FIG. 5, a longitudinal edge 46 of the lip 45 does not extend into contacting engagement with the web 37 of the channel of the socket 31. When thus assembled, the bead 37 is secured in its respective groove 38 with an end edge 47 of the terminal edge strip in contact with a longitudinally extending sidewall 38*a* of the groove.

A sealing element 48 is also included in this structure and comprises an elongated strip of elastomeric material such as a rubber or other material having suitable resilient characteristics. This strip, which may be of a generally rectangular cross-section, is preferably adhesively bonded to a surface of either the tongue or socket and is disposed between the opposed surfaces of the channel web 37 and the end surface 44 of the tongue 30 as well as between the opposed surfaces of the lip 45 and inner surface of the channel flange 33. By appropriate dimensioning of the thickness of the sealing strip 48, the strip will be placed under compression when the tongue and socket are assembled into interlocked relationship and thus form an excellent fluid impervious seal. As indicated, the sealing strip 48 may be secured to either element as by an appropriate adhesive bonding material and is thus maintained in preassembled position for utilization in the field. An advantage of securing the sealing strip 48 to the inner corner of the channel 32 is that it will be well protected during transport, storage and during preassembly operations.

Figure 6:
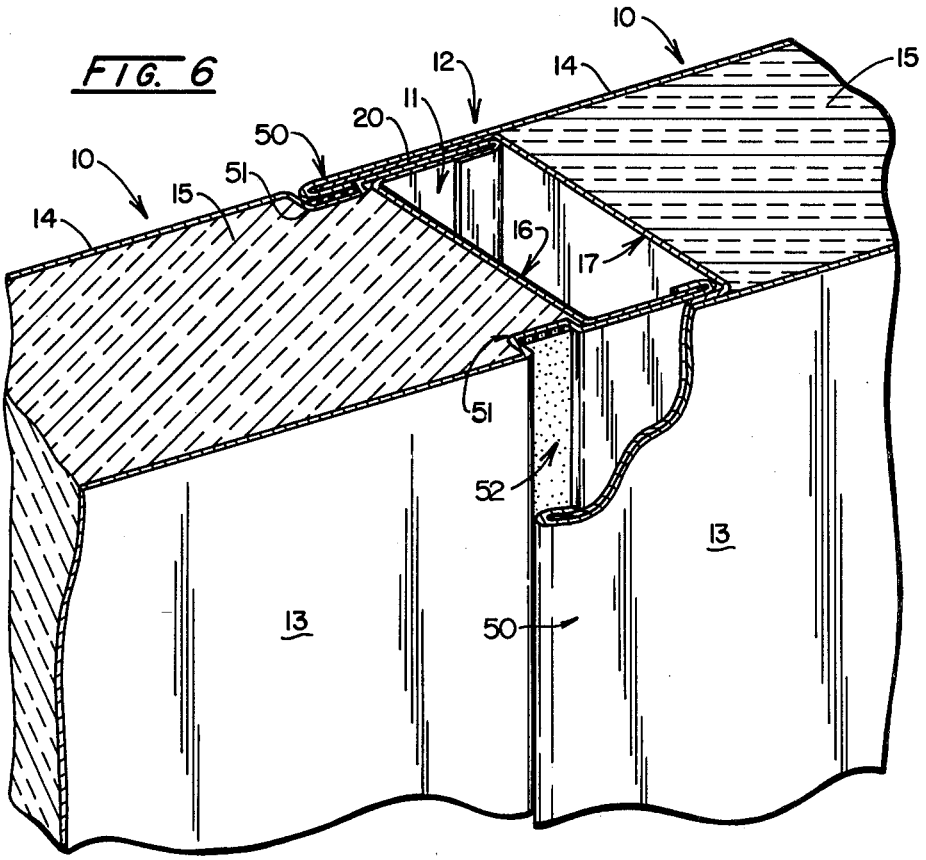
FIG. 6 is a perspective view of a fragmentary wall section comprising a pair of adjacently disposed panels embodying a modified seal arrangement.

An alternative configuration of the panel structure is shown in FIG. 6 where two of these alternatively configured panels 10 are illustrated in assembled relationship with portions of the one panel broken away for clarity. Each of the panels is formed with opposed sheet metal skins 13 and 14 and longitudinally extending edge portions forming respective interfitting tongues and sockets 11 and 12. These panels are thus seen to be substantially similar in configuration to those shown in FIG. 1 and are provided with bead and groove conformations 18*a* and 19*a* that interfit in interlocking engagement when two adjacently disposed panels are assembled as illustrated.

In this alternative configuration of FIG. 6, a sealing strip 50 formed from an elastomeric material is also provided as an integral part of each panel structure at the time of initial fabrication. However, in this instance the sealing strip 50 is disposed in each of the grooves 18*a* where it is secured by suitable adhesives or other appropriate attaching techniques. Each groove 18*a* in this configuration is of a generally rectangular cross-section having a depth increased over that of the FIG. 1 embodiment to the extent that it will accommodate the thickness of the flat sealing strip 50 when the respective bead 19*a* having an inwardly facing, flat contacting surface is interlocked therein but will result in subjecting the sealing strip to a sufficient compressive force as to form an effective seal. It will be noted that the sealing strip 50 in this alternative configuration is also very adequately protected against mechanical injury since the exterior surface of the sealing strip is relatively recessed in the groove with respect to the exterior surfaces of either panel skins 13 and 14 or the surfaces of the tongue 11. Thus, these panels may also be stored or transported in stacked relationship without consideration of additional protection of a temporary nature for the sealing strip while retaining the advantages of a panel having a factory applied sealing strip.

It will be readily apparent that a particularly novel and advantageous structure is provided in a modular building panel where a sealing strip is integrally incorporated in preassembled relationship. The arrangement and positioning of the sealing strip which is fabricated from an elastomeric material, on a tongue or socket portion of interlocking panels, results in a positive seal being assured upon assembly of adjacent panels. Preassembly of the sealing strip with the panel improves economy of assembly operations through elimination of the field application of sealing materials as a cost factor and the likelihood of forming an ineffective seal.

Having thus described this invention, what is clained is:

1. A modular building panel comprising a structurally rigid, elongated panel having opposed, longitudinally extending, marginal edge portions of mating tongue and socket configuration which are each adapted to interfit edgewise with a mating marginal edge portion of an adjacent panel, said opposed marginal edge portions having respective bead and groove conformations extending longitudinally thereof and configured to interlockingly interfit, said groove formed in the tongue-forming marginal edge portion and opening outwardly with respect to a surface of the panel, said socket-forming marginal edge portion having spaced sidewalls defining a channel therebetween for receiving a tongue marginal edge portion, one of said sidewalls having a terminal edge strip formed along an outer longitudinally extending edge thereof and folded inwardly of the channel in superposed relationship to a surface of the sidewall and forming said bead for interlocking with a groove, and an elongated, flat sealing strip formed from an elastomeric material carried by and disposed in longitudinally extending relationship to said one sidewall at the inwardly facing surface thereof, said sealing strip being of a predetermined width having a longitudinally extending marginal edge portion disposed in underlying relationship to said sidewall terminal edge strip and forming a cooperative fluid-sealing interengagement with the tongue-forming marginal edge portion of another panel when assembled therewith and having the respective bead and grooves thereof disposed in interlocked engagement, said sealing strip extending substantially the length of the panel.

2. A modular building panel according to claim 1 wherein said sealing strip is secured to the sidewall of said socket marginal edge portion by clamped engagement therewith.

3. A modular building panel according to claim 1 wherein said sealing strip has the longitudinally extending marginal edge portion thereof secured in clamped relationship to said sidewall.

4. A modular building panel according to claim 3 wherein the sidewalls defining the channel of said socket marginal edge portion are formed by lateral extensions of skins forming respective sides of the panel, said sidewall terminal edge strip folded into parallel relationship to said lateral extension and forming a protective edge cover for the sealing strip marginal edge portion disposed thereunder.

5. A modular building panel according to claim 4 wherein said socket marginal edge portion includes a channel having a flange extending in parallel relationship to said lateral extension and terminating within the overlapped portions of said lateral extension and sidewall terminal edge strip, said sealing strip clamped in contacting engagement between said flange and said terminal edge strip.

6. A modular building panel according to claim 1 wherein said sealing strip is secured to the sidewall of said socket marginal edge portion by having the marginal edge portion of said strip disposed in clamped engagement by said sidewall terminal edge strip, said sealing strip marginal edge portion being subjected to compressive clamping force of predetermined magnitude producing a frictional retaining force that permits said sealing strip to be pulled out of said clamped engagement when subjected to a predetermined pulling force.

* * * * *